US005337569A

United States Patent [19]

Darredeau

[11] Patent Number: 5,337,569

[45] Date of Patent: Aug. 16, 1994

[54] PROCESS AND INSTALLATION FOR THE TRANSFER OF LIQUID

[75] Inventor: Bernard Darredeau, Sartrouville, France

[73] Assignee: L'Air Liquide, Societe Anonyme pour L'Etude et L'Exploitation des Procedes Georges Claude, Paris, France

[21] Appl. No.: 31,490

[22] Filed: Mar. 15, 1993

[30] Foreign Application Priority Data

Mar. 24, 1992 [FR] France ..... 92 03500

[51] Int. Cl.[5] ..... F25J 3/04

[52] U.S. Cl. ..... 62/22; 62/24

[58] Field of Search ..... 62/13, 23, 26, 42, 36, 62/22

[56] References Cited

U.S. PATENT DOCUMENTS

| | | | |
|---|---|---|---|
| 3,059,440 | 10/1962 | Loporto | 62/41 |
| 3,217,502 | 11/1965 | Keith, Jr. | 62/13 |
| 3,222,878 | 12/1965 | Becker | 62/13 |
| 4,137,056 | 1/1979 | Golovko | 62/29 |
| 4,962,646 | 10/1990 | Ratabone | 62/24 |
| 4,977,746 | 12/1990 | Grenier et al. | 62/22 |
| 5,123,249 | 6/1992 | Buttle | 62/24 |

FOREIGN PATENT DOCUMENTS 2320512 3/1977 France .

OTHER PUBLICATIONS

"Nuclear Instruments and Methods", *A Cryostat for Ge(Li)-Detectors With Internal Liquid Circulation and a Swiveling Cold Finger,* vol. 66, 1968, by C. M. Fleck et al. pp. 304–308.

*Primary Examiner*—Ronald C. Capossela

*Attorney, Agent, or Firm*—Young & Thompson

[57] ABSTRACT

Process and installation for transferring a liquid, via a rising conduit (6, 9, 11, 12) provided with an expansion valve (7, 10, 13), from a first distillation column (2), operating at a first pressure, to equipment (3), particularly a second distillation column, operating at a pressure lower than the first pressure. There is injected into the rising conduit, downstream of the expansion valve, a lift gas available at a pressure greater than the pressure created by a column of liquid between the point of injection of the gas and the point of introduction of the liquid into the equipment (3). The lift gas is available at the pressure of the first distillation column (2) and is injected into the liquid in the rising column above the point of withdrawal of this liquid. There is used as lift gas a gas withdrawn from a point in the first column (2) and so chosen as not to modify substantially the composition of the transferred liquid, or a portion of the air feed to the installation can be used for this purpose.

12 Claims, 1 Drawing Sheet

PROCESS AND INSTALLATION FOR THE TRANSFER OF LIQUID

FIELD OF THE INVENTION

The present invention relates to a process for transfer of a liquid, through a rising conduit provided with an expansion valve, from a first distillation column operating at a first pressure, typically relatively high, to equipment, particularly a second distillation column, operating at a second pressure, typically relatively low, lower than the first pressure.

It is applicable particularly to the raising of liquids from a medium pressure column of a double air distillation column, toward the low pressure column surmounting this medium pressure column of the double column, and/or toward the head condenser of a column for oxygen/argon separation connected to the low pressure column.

BACKGROUND OF THE INVENTION

Apparatus for the separation of the gases of air by cryogenic distillation use most often the conventional double column arrangement. The liquids produced at the bottom (liquid rich in oxygen), in the intermediate part (lean liquid) and at the top (liquid nitrogen) of the medium pressure column (or MP column), are sent to an intermediate point or to the top of the low pressure column (or LP column). Most often, for economic reasons, the low pressure column is placed above the medium pressure column. It is thus necessary to convey the liquids to a point located higher than the point from which they are removed. Conventionally, the pressure difference between the medium pressure column and the low pressure column is greater than the hydrostatic pressure of the liquid column between the removal point from the MP column and the inlet point of the LP column.

The recent evolution of the technology of air distillation columns has seen the appearance, on the one hand, of packed columns with low pressure drop, and on the other hand, of vaporizer/condensers with small temperature difference between the two fluids in heat exchange relation (gaseous nitrogen and liquid oxygen). These two improvements permit a reduction of the operating pressure of the medium pressure column, so as to reduce the expenditure of energy, and also an increase in the height of the columns, the economic optimum being in the direction of a more extended distillation.

On the other hand, an unfavorable consequence of this development is the difficulty of raising the liquids by simple hydrostatic effect. Thus, under certain conditions, the pressure available in the MP column is not sufficient to raise the liquids to the LP column, particularly when the apparatus must be subject to reduced operation, which is to say with a lower pressure of the MP column than under rated conditions.

The state of the art permits solving this problem using pumps which raise the liquids to sufficient pressures. The drawbacks are obvious: cost of energy, cost of investment, reduced reliability of the apparatus, greater complexity of operation, etc.

SUMMARY OF THE INVENTION

The invention has for its object to permit in a simple and efficacious manner, the transfer of the liquids without use of a pump.

To this end, the process according to the invention is characterized in that there is injected in the rising conduit, downstream of the expansion valve, a lift gas (which is to say a gas whose bubbles reduce the overall density of the liquid) available at a pressure greater than the pressure created by a column of said liquid between the point of injection of the gas and the point of introduction of the liquid into said equipment.

According to other characteristics:

—the lift gas is available at the pressure of said first distillation column and is injected in the liquid in the rising column, above the point of removal of this liquid;

—there is utilized as lift gas a gas withdrawn from a point in the first column and so selected as not to modify substantially the composition of the liquid transferred;

—for the transfer of the liquid from the base of the medium pressure column of a double air distillation column to an intermediate point of the low pressure column, surmounting this medium pressure column of the double column, and/or to the head condenser of an oxygen/argon separation column coupled to the low pressure column, there is used a small entering air flow as lift gas.

According to a second aspect, the invention has for its object a transfer process for a liquid, via a rising conduit, provided with an expansion valve, from a first distillation column operating at a first pressure to equipment, particularly a second distillation column, operating at a second pressure, lower than the first pressure, characterized in that the liquid is subcooled before its expansion, except a minor fraction of this liquid, so as to produce a controlled quantity of flash gas serving as the lift gas for the liquid.

The invention also has for its object a distillation installation adapted to practice this process. According to a first aspect, this installation, of the type comprising a first distillation column operating at a first pressure, an equipment, particularly a second distillation column, operating at a second pressure lower than the first pressure, and a rising conduit provided with an expansion valve and connecting a withdrawal point of the liquid from the first column to an introduction point of the liquid into said equipment, is characterized in that it comprises injection means in the rising column, downstream of the expansion valve, for a lift gas available at a pressure higher than the pressure created by a column of said liquid between the point of injection of the gas and the point of introduction of the liquid into said equipment.

According to a second aspect, the installation according to the invention, of the type comprising a first distillation column operating at a relatively high pressure, equipment, particularly a second distillation column, operating at a relatively low pressure, and a rising conduit provided with an expansion valve and connecting a withdrawal point of the liquid from the first column to an introduction point of the liquid into said equipment, is characterized in that the rising column passes through a subcooler upstream of the expansion valve and is provided with a bypass around this subcooler.

BRIEF DESCRIPTION OF THE DRAWINGS

Examples of operation of the invention will now be described with respect to the accompanying drawing, in which.

DETAILED DESCRIPTION OF THE INVENTION

Figures 1, 2, 3:
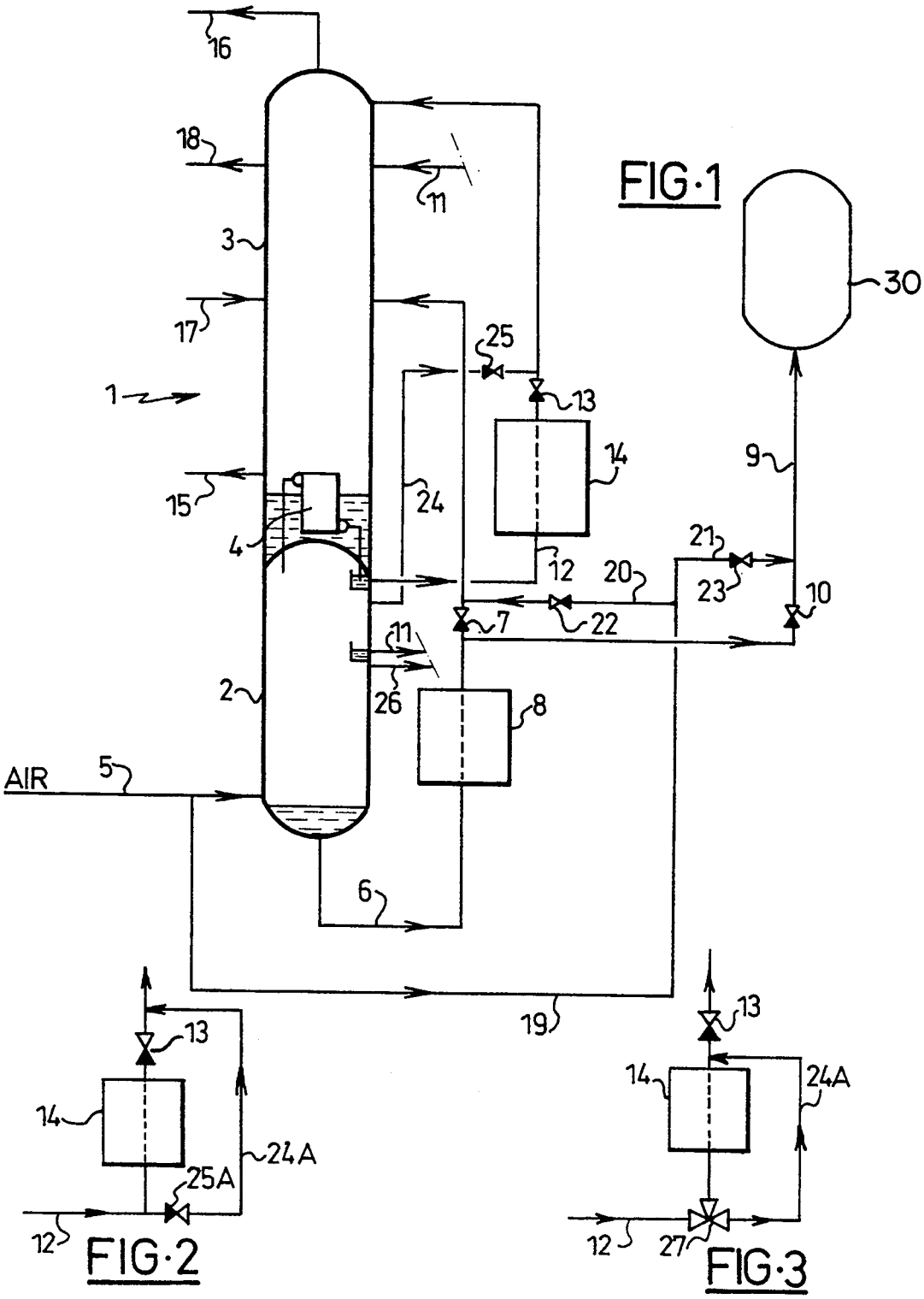
—FIG. 1 shows schematically an air distillation installation according to the invention.
—FIGS. 2 and 3 show two modifications of the invention.

The air distillation installation shown in FIG. 1 comprises essentially a double distillation column 1. The latter comprises a medium pressure column 2 surmounted by a low pressure column 3. A vaporizer/condenser 4 places in heat exchange relation the vapor at the head of column 2, constituted by practically pure nitrogen, and the liquid in the bottom of column 3, constituted by oxygen of a certain purity.

In operation, the air at a pressure typically of $5\times10^5$ to $6\times10^5$ Pa is introduced in the base of the column 2 via a supply conduit 5. "Rich liquid" (air enriched in oxygen) is withdrawn from the base of this column 2 via a conduit 6 provided with an expansion valve 7, subcooled in a subcooler 8 upstream of this expansion valve, expanded in this latter to a pressure slightly greater than atmospheric pressure, and introduced at an intermediate point of LP column 3. Between the subcooler 8 and the expansion valve 7 there opens a rising conduit 9 provided with an expansion valve 10 and leading to the condenser at the head of an oxygen/argon separation column 30 coupled to the LP column 3 in a known way.

"Lean liquid" (impure nitrogen) is withdrawn from an intermediate point of column 2 via a conduit 11 provided with an expansion valve (not shown) and, after subcooling and expansion, is introduced at an intermediate point of the column 3. Practically pure liquid nitrogen is withdrawn from the head of column 3 via a conduit 12 provided with an expansion valve 13, subcooled in a subcooler 14 upstream of this expansion valve, expanded in this latter and introduced at the top of column 3.

There is also shown in FIG. 1 conduits 15 for gaseous oxygen production from the base of column 3, 16 for pure nitrogen production from the top of this column 3, 17 for air introduction to an intermediate point of column 3, and 18 for withdrawal of residual gas (impure nitrogen) from the upper part of this column.

It will be seen that three different liquids must be raised from the lower column 2 to the upper column 3 and that a liquid must be raised to the head of the oxygen/argon separation column. If these columns are of the packed type, in particular structured and/or having numerous theoretical plates and/or if the vaporizer/condenser 4 is of a small temperature difference type, it can happen that the difference of pressure between the two columns 2 and 3 will be hardly sufficient to ensure the raising of the liquids.

To guarantee good raising of the liquids, in a regular and controlled manner, in all the modes of operation of the installation, an air conduit 19 is branched from the supply conduit 5 and is divided into two branches 20, 21. Each of these branches is provided with an expansion valve 22, 23 and rejoins respectively the conduits 6 and 9 just downstream of their expansion valves 7 and 10. Similarly, a gas conduit 24 provided with an expansion valve 25 leaves the top of column 2 and rejoins conduit 12 just downstream of the expansion valve 13. Another gas conduit 26, provided with an expansion valve (not shown), leaves the column 2 adjacent the point of withdrawal of lean liquid (conduit 11) and rejoins this conduit 11 just downstream of the expansion valve of the latter.

In operation, a small air flow sent, at the supply pressure of the column 2, by the conduit 19, 20, is expanded in the expansion valve 22 and injected in the rich liquid which has been expanded in the expansion valve 7. The air bubbles lift the rich liquid and reduce the pressure necessary to make it rise to the column 2.

In the same way, a small air flow carried by the conduit 19, 21 is expanded in the expansion valve 23 and injected in the rich liquid which has been expanded in the expansion valve 10. The total air flow diverted by the conduit 19 is small, typically less than 1% of the air flow entering the installation, Similarly, the practically pure nitrogen conveyed by the conduit 24 is expanded in the expansion valve 25 and injected in the liquid nitrogen which has been expanded in the expansion valve 13, and impure nitrogen carried by the conduit 26 is, after expansion, injected into the lean liquid carried by the conduit 11 and expanded.

It is to be noted that, because of the purity of the liquid nitrogen carried by the conduit 12, the corresponding lift gas (in the conduit 24) should be practically pure nitrogen. On the other hand, the compositions of the rich liquid and the lean liquid are not critical, such that the corresponding lift gases can have compositions somewhat different from these liquids, provided that they do not pollute them, as the flow of these gases is very small.

In practice, the principal expansion valves 7, 10 and 13 are disposed as low as possible to guarantee their supply entirely by liquid, and there are introduced gas bubbles just downstream of these expansion valves to assist the propulsion upwardly of the liquids in question. More precisely, the pressure of the lift gases should be sufficient to overcome the height of the liquid which is above the point of injection of the gas, and this pressure is obtained, in the illustrated example, thanks to the fact that each gas, which is available at the pressure of the column 3, is injected above the point of withdrawal of the associated liquid.

FIGS. 2 and 3 show, in the case of raising liquid nitrogen via conduit 12, two modifications for obtaining the lift gas. In these two modifications, the conduit 24 and the expansion valve 25 are omitted.

In the modification of FIG. 2, a minor controlled liquid nitrogen flow carried by the conduit 12 bypasses the subcooler 14 via a bypass conduit 24A provided, preferably at its lowest point, with an expansion valve 25A and opening above the expansion valve 13.

The liquid thus derived, not being subcooled, produces upon expansion a relatively great and adjustable quantity of flash gas, which serves as lift gas.

In the modification of FIG. 3, the expansion valve 25A is omitted, and there is provided in conduit 12 a three-way valve 27 having an input connected to the conduit 12 upstream of the subcooler 14, an outlet connected to the entry of this subcooler and an other outlet connected to the bypass conduit 24A. Moreover, this conduit 24A opens upstream of the expansion valve 13.

Thus, a minor controlled liquid nitrogen flow is not subcooled, such that an adjustable quantity of flash gas is produced during expansion in the expansion valve 13 and serves as the lift gas.

Of course, the modifications according to FIGS. 2 and 3 are equally applicable to the raising of other liquids.

It will be understood that the modifications of FIGS. 2 and 3, although based on the same idea as that of FIG. 1, are less effective in the sense that they permit lifting the rising liquids by limiting to a minimum the production of flash gas, which is unfavorable to distillation but which do not permit the restarting of the installation in case of accidental flooding of the rising conduits.

What is claimed is:

1. Process for transferring a liquid from a first distillation column, operating at a first pressure, to equipment operating at a pressure lower than the first pressure, comprising: withdrawing liquid from said first column, via a rising conduit provided with an expansion valve, injecting into the rising conduit, downstream of the expansion valve, bubbles of a lift gas at a pressure greater than the pressure created by a column of liquid between the point of injection of the gas and the point of introduction of the liquid into said equipment, and transferring said liquid with said injected bubbles of lift gas into said equipment.

2. Process according to claim 1, wherein the lift gas is at the pressure of said first distillation column and is injected into the liquid in the rising conduit above the point of withdrawal of the liquid from the first column.

3. Process according to claim 2, further comprising using as lift gas, a gas withdrawn from a point in the first column so chosen as not to modify substantially the composition of the transferred liquid.

4. Process according to claim 2, wherein the liquid is withdrawn from the base of a medium pressure column of a double air distillation column and transferred to an intermediate point in a low pressure column surmounting said medium pressure column, and using a small flow of air fed to the double column as the lift gas.

5. Process according to claim 2, wherein the liquid is withdrawn from the base of a medium pressure column of a double air distillation column and transferred to a head condenser of an oxygen/argon separation column, said medium pressure column being surmounted by a low pressure column, and said separation column being fluidly coupled to the low pressure column, and using a small flow of air fed to the double column as the lift gas.

6. Transfer process for a liquid from a first distillation column, operating at a first pressure, to equipment operating at a second pressure lower than the first pressure, comprising: withdrawing liquid from said first column, via a rising conduit provided with an expansion valve, dividing the liquid into a major fraction and a minor fraction, subcooling the major fraction of the liquid before its expansion, introducing the minor fraction of the liquid into said rising conduit to produce upon expansion a controlled quantity of flash gas serving as a lift gas for the liquid in the rising conduit, and transferring said liquid with said flash gas into said equipment.

7. Distillation installation, comprising a first distillation column operating at a first pressure, equipment operating at a second pressure lower than the first pressure, and a rising conduit provided with an expansion valve and connecting a withdrawal point of liquid from the first column to a point of introduction of the liquid into said equipment, located above the point of withdrawal of said liquid, injecting means for injecting lift gas into the rising conduit, downstream of the expansion valve, and means for supplying said lift gas to said injection means at a pressure higher than the pressure created by a column of said liquid between the point of injection of the gas and the point of introduction of the liquid into said equipment.

8. Installation according to claim 7, wherein the means for supplying the lift gas is fluidly connected to the first column, and said injection means open into the rising conduit at a level above said withdrawal point of liquid from the first column.

9. Installation according to claim 8, wherein said injection means comprise a gas conduit provided with an expansion valve and originating from a point in the first column adjacent to said withdrawal point of said liquid from said first column.

10. Installation according to claim 8, wherein the first column is a medium pressure column of a double air distillation column and said equipment is a low pressure column, surmounting said medium pressure column of the double column, said injection means including a conduit provided with an expansion valve and extending from an input conduit for air to be distilled or from the base of the medium pressure column.

11. Installation according to claim 8, wherein the first column is a medium pressure column of a double air distillation column and said equipment is a condenser at the head of an oxygen/argon separation column fluidly coupled to the low pressure column, said injection means including a conduit provided with an expansion valve and extending from an input conduit for air to be distilled or from the base of the medium pressure column.

12. Distillation installation, comprising a first distillation column operating at a relatively high pressure, equipment operating at a relatively low pressure, and a rising conduit provided with an expansion valve and connecting a withdrawal point of liquid from the first column to a point of introduction of liquid into said equipment, said rising conduit including a subcooler upstream from the expansion valve, and being provided with a bypass about said subcooler through which passes a minor fraction of the liquid in the rising conduit, and means for returning said minor fraction to said rising conduit downstream from said subcooler so as to produce flash gas serving as lift gas for the liquid in said rising conduit.

* * * * *